US006691995B2

(12) United States Patent
Held

(10) Patent No.: US 6,691,995 B2
(45) Date of Patent: Feb. 17, 2004

(54) CONVEYING UNIT FOR FLAT OBJECTS

(75) Inventor: Berthold Peter Held, Heuchelheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/311,303

(22) PCT Filed: Dec. 14, 2001

(86) PCT No.: PCT/DE01/04717

§ 371 (c)(1),
(2), (4) Date: Dec. 27, 2002

(87) PCT Pub. No.: WO02/070384

PCT Pub. Date: Sep. 12, 2002

(65) Prior Publication Data

US 2003/0102616 A1 Jun. 5, 2003

(30) Foreign Application Priority Data

Mar. 6, 2001 (DE) ..... 101 11 361

(51) Int. Cl.[7] ..... B65H 39/10

(52) U.S. Cl. ..... 270/47; 270/48; 493/357; 493/416; 493/436; 271/216

(58) Field of Search ..... 270/47, 48, 49, 270/50; 493/357, 416, 436; 271/274, 275, 216; 198/604, 626.1, 347.3

(56) References Cited

U.S. PATENT DOCUMENTS

| | | | | |
|---|---|---|---|---|
| 3,345,923 A | | 10/1967 | Erk | |
| 4,211,396 A | * | 7/1980 | Michalik et al. | 270/13 |
| 4,279,410 A | * | 7/1981 | Bolza-Schunemann | 270/6 |
| 4,344,610 A | * | 8/1982 | Jeschke et al. | 270/6 |
| 4,381,106 A | * | 4/1983 | Loebach | 270/47 |
| 4,461,464 A | * | 7/1984 | Petersen | 270/47 |
| 4,490,132 A | * | 12/1984 | Ogura et al. | 493/424 |
| 4,974,822 A | * | 12/1990 | Richter | 270/48 |
| 5,405,126 A | * | 4/1995 | Mack | 270/6 |

FOREIGN PATENT DOCUMENTS

| | | |
|---|---|---|
| DE | 1 210 315 | 2/1966 |
| DE | 6925525 | 6/1969 |
| DE | 42 41 810 A1 | 6/1994 |

* cited by examiner

*Primary Examiner*—Patrick MacKey
(74) *Attorney, Agent, or Firm*—Jones, Tullar & Cooper PC

(57) ABSTRACT

A conveying unit that is useable for the conveyance of generally flat objects, particularly in a folder of a rotary printing press, includes endless first and second belts and a roller. A conveying path for the flat objects extends initially between the two belts and then subsequently between the second belt and the surface of the roller. The second belt is driven by a drive device at a speed which can be regulated independently of the rotational speed of the roller.

19 Claims, 1 Drawing Sheet

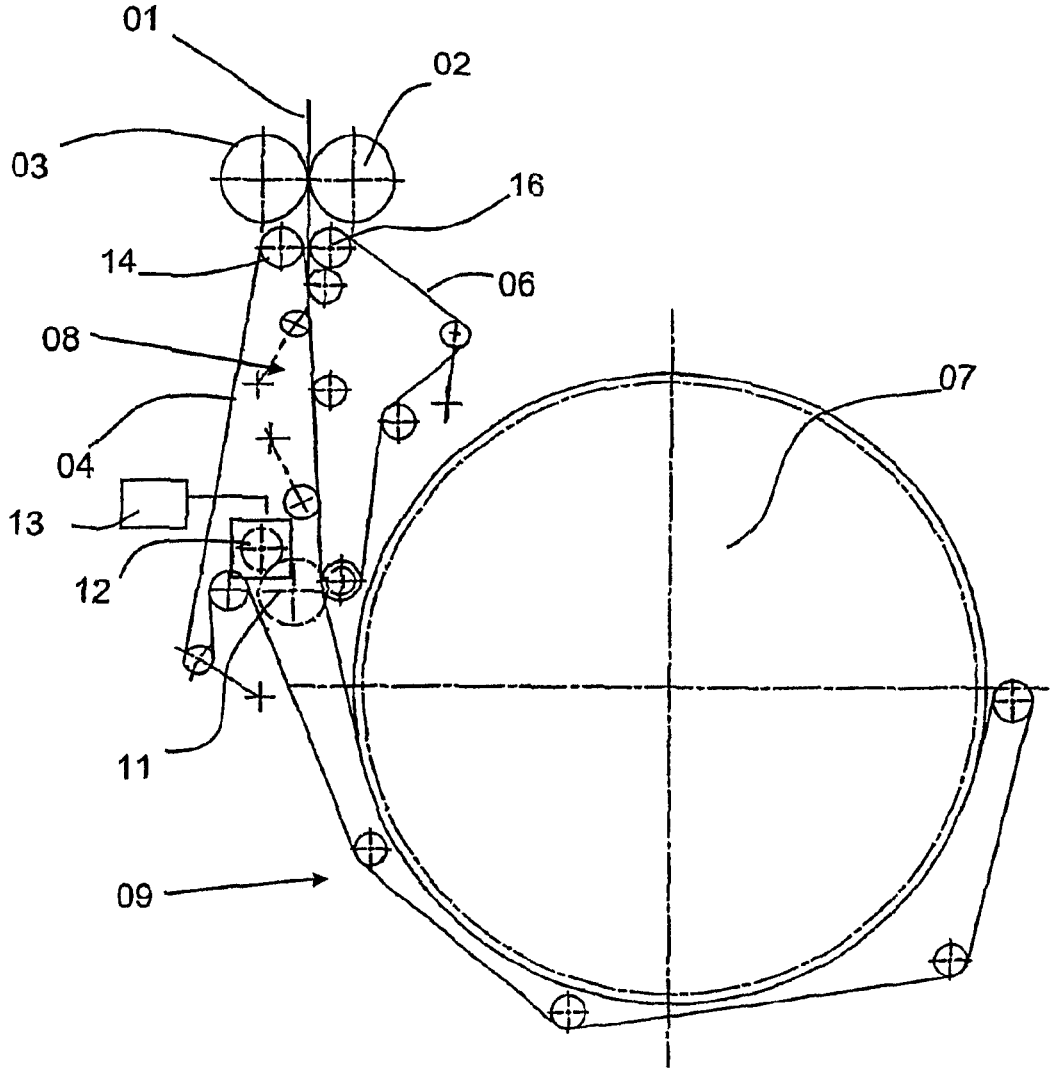
01
02
03
16
14
06
08
07
04
13
12
11
09

CONVEYING UNIT FOR FLAT OBJECTS

FIELD OF THE INVENTION

The present invention is directed to a conveying unit for conveying flat objects. The conveying unit includes first and second endless belts and a roller.

BACKGROUND OF THE INVENTION

Conveying units are employed in folding apparatus for conveying signatures. These signatures have previously been cut off a web of imprinted material.

The signatures each can consist of a variable number of sheets which sheets are not connected with each other. In the course of conveying the signatures, it is therefore of great importance that the two endless belts and the roller move at speeds which are exactly matched to each other in order to prevent shearing forces from acting on the signatures that are clamped between them. Such shearing forces might lead to deformation and fanning of the signatures in the course of their conveyance.

In conventional conveying units, the movement of the second endless belt is coupled, via a transmission gear with a fixed transmission ratio, to the rotation of the roller. The first endless belt, which partially loops around the roller, is driven by the roller by friction. Therefore, the path speed of the first belt corresponds to the circumferential speed of the roller if no objects are conveyed between them. If conveyed objects are located in the loop area between the roller and the first belt, this has an effect on the speed of the first belt which is similar to an increase in the diameter of the roller. The speed of the first belt therefore increases with the thickness of the objects to be conveyed. The speed of the second belt is constant. This has the result that only with a definite thickness of the objects to be conveyed do the two belts run exactly the same, so that the objects to be conveyed are not subjected to shearing forces.

DE 42 41 810 A1 discloses a folding apparatus wherein first and second belts are arranged between the cutting cylinder and the folding cylinder. These belts are driven together by a common motor.

SUMMARY OF THE INVENTION

The object of the present invention is directed to providing a conveying unit for flat objects.

In accordance with the present invention, this object is attained by the provision of first and second endless belts and a roller. A first conveying path section extends between the first endless belt and the second endless belt. A second section of the conveying path extends between the first endless belt and the circumference of the roller. The first endless belt and the second endless belt are driven independently of each other.

The advantages which can be attained by the present invention reside, in particular, in that it is always possible to produce the same speed between the two endless belts, even with differences in the thickness of the objects to be conveyed, so that the objects can be conveyed gently and free of shearing forces.

The conveying unit has a drive mechanism for the second belt which can be regulated independently of the speed of rotation of the roller.

This drive mechanism is preferably associated with a regulating device that is acting to match the speeds of the two belts. This regulating device preferably regulates the speed of the second belt proportionally to the speed of rotation of the roller by the use of a variable proportionality factor. By matching the proportionality factor as a function of the thickness of the objects to be conveyed, it is possible to assure that objects of variable thickness are conveyed free of shearing forces.

To determine the proportionality factor, the regulating device can be connected to a sensor for measuring the speed of the first belt. The speed of the first belt varies linearly with the thickness of the conveyed objects. Freedom from shear forces acting on the conveyed objects can be achieved by a simple matching of the speed of the two belts.

It is also within the scope of the present invention to couple the regulating device to a sensor for detecting the shearing deformation of the conveyed objects. For example, such a sensor can be implemented as a camera with a connected electronic image processor. It is also possible for an operator to manually vary the proportionality factor on the basis of a detected shear deformation of the conveyed objects.

Another option is to couple a sensor for detecting the thickness of the objects to the regulating device. Such a sensor can be particularly arranged upstream of the input of the regulating device. This makes it possible to match the belt speeds of the conveying unit to a change in thickness of the object before the object, on which the thickness measurement had been performed, reaches the conveying device.

BRIEF DESCRIPTION OF THE DRAWING

A preferred embodiment of the present invention is represented in the sole drawing and will be described in greater detail in what follows.

The sole drawing shows a schematic section through a conveying unit in accordance with the present invention.

DESCRIPTION OF THE PREFERRED EMBODIMENT

The conveying unit depicted in the sole drawing is arranged following a cutting unit that is constituted by a cutter cylinder 02 and an oppositely located groove cylinder 03. A web of material 01, for example a paper web 01, which has been cut into partial web strands in a superstructure, which is not represented and which is located above the cutting unit, with the aid of several rotating longitudinal cutters and which web strands have been placed one on top of the other, is cut into individual signatures. These resulting signatures consist of a varying number of paper sheets placed on top of each other, which sheets placed on top of each other are not maintained fixedly attached to each other and are therefore open on all four sides.

The path along which the signatures are conveyed by the conveying unit can be divided into two sections, a first conveying path section 08, in which the signatures are conveyed, pressed between a first endless belt 04 and a second endless belt 06, and a second conveying path section 09, in which the signatures are conveyed between the first endless belt 04 and a roller 07, for example a collecting cylinder 07 and/or a folding blade cylinder of a folding apparatus of a rotary printing press.

The collecting cylinder 07 is driven by a drive motor, which is not specifically represented in the drawing. The first endless belt 04, which in the second conveying path section 09 loops around the collecting cylinder 07 over an angular range of at least 90°, and preferably in the range of approximately 180°, is driven by the collecting cylinder 07 by friction. If signatures are conveyed in the second conveying path section 09, they transfer the driving force from the collecting cylinder 07 to the first endless belt 04. In this case, the outsides of the signatures facing away from the collecting cylinder 07 have a slightly higher path speed than the shell surface of the collecting cylinder 07 itself because of their greater distance from the center of rotation of the collecting cylinder 07. This speed difference is proportional to the thickness of the signatures. Therefore, with a change in the thickness of the signatures, the speed of the first endless belt 04 is automatically changed.

The second endless belt 06 is driven by a frequency-regulated motor 12 through an intermediate drive wheel 11. The speed of the motor 12 is regulated by a regulating device 13 whose object it is to keep the path speeds of the two endless belts 04 and 06 identical to each other and to prevent, in this way, the displacement of the sheets of the signatures with respect to each other during the passage of the signatures through the first conveying path section 08. With such displacement of the sheets, the signatures become unsightly or unusable.

In a first embodiment of the present invention, the regulating device 13 is connected with two speed sensors for detecting the path speeds of the first and the second endless belt 04 and 06. The regulating device acts toward a match of these path speeds. The speed sensors can be angle of rotation sensors, which are each arranged on deflection rollers 14 or 16 of the first or second endless belts 04, 06, respectively. These sensors each send a pulse to the regulating device every time the deflection roller 14 or 16 has traveled over a fixed angle of rotation. These angle of rotation sensors are preferably identically constructed and are mounted on deflection rollers 14, 16 which are of identical radii. In this case, the regulating device 13 can assure an identical path speed of the endless belts 04, 06 in that it maintains a constant, and preferably vanishing phase offset between the pulses delivered by the two sensors. The result is that the speed of the second endless belt 06 is proportional to the speed of the collecting cylinder 07. The proportionality factor is determined by the thickness of the signatures conveyed between the collecting cylinder 07 and the first endless belt 04.

Another possibility for regulating the speed of the second endless belt 06 is to connect the regulating device 13 on the one hand with a sensor for the speed of the first endless belt 04 or the rotational speed of the collecting cylinder 07 and, on the other hand, with a sensor for the thickness of the signatures to be conveyed. Then the regulating device 13 calculates a speed to be maintained by the motor 12, and thus of the second belt 06 from the measured speed of the collecting cylinder 07, corrected by a proportionality factor which is a function of the measured thickness of the signatures. A sensor for the thickness of the signatures, or of a value proportional thereto, can be arranged at any arbitrary location in the conveying unit itself or, better yet, upstream of the start of the conveying unit and at a location along the path of travel of the web of material 01.

It is also within the scope of the present invention that an operator can set a known thickness of the signatures, the number of their sheets and the basis weight, or any arbitrary equivalent combination of parameters as the regulator for the regulating device 13.

An operator can also make later corrections by the use of such a regulator when he detects that the signatures conveyed by the conveying unit are being sheared.

In accordance with another preferred embodiment of the present invention, which is not represented, a camera with an image processing unit is provided at the outlet of the conveying unit, which camera monitors the conveyed signatures for the occurrence of shearing. If shearing is detected by this camera, the regulating device 13 varies the proportionality factor, which was determined by it, between the speed of rotation of the collecting cylinder 07 and the speed of travel of the second endless belt 06 until the shearing of the signatures disappears or is reduced to an acceptable value.

While preferred embodiments of a conveying unit for flat objects in accordance with the present invention have been set forth fully and completely hereinabove, it will be apparent to one of skill in the art that changes in, for example, the overall size of the roller, the specific construction of the belts and the like could be made without departing from the true spirit and scope of the present invention which is accordingly to be limited only by the following claims.

What is claimed is:

1. A conveying unit for flat objects comprising:

a first endless belt;

a second endless belt, said first and second endless belts defining a first conveying path section;

a roller, said roller having a circumferential surface, said circumferential surface and said first endless belt defining a second conveying path section, said first and second conveying path sections together forming a conveying path for flat objects; and means driving said first endless belt and said second endless belt independently of each other.

2. The conveying unit of claim 1 further including a regulatable drive arrangement for said second endless belt.

3. The conveying unit of claim 2 further including a regulating device for said regulatable drive arrangement, said regulating device being operable to match speeds of said first and second endless belts.

4. The conveying unit of claim 3 wherein said roller has a roller rotation speed and further wherein said regulating device regulates said speed of said second endless belt proportionally to said roller rotation speed by means of a variable proportionality factor.

5. The conveying unit of claim 3 further including a sensor useable to measure said speed of said first endless belt, said first belt speed sensor being connected to said regulating device.

6. The conveying unit of claim 4 further including a sensor useable to measure said speed of said first endless belt, said first belt speed sensor being connected to said regulating device.

7. The conveying unit of claim 3 further including a sensor useable to measure a shearing deformation of conveyed flat objects, said shearing deformation sensor being connected to said regulating device.

8. The conveying unit of claim 4 further including a sensor useable to measure a shearing deformation of conveyed flat objects, said shearing deformation sensor being connected to said regulating device.

9. The conveying unit of claim 3 further including a sensor useable to measure a thickness of conveyed objects, said thickness sensor being connected to said regulating device.

10. The conveying unit of claim 4 further including a sensor useable to measure a thickness of conveyed objects, said thickness sensor being connected to said regulating device.

11. The conveying unit in accordance with claim 9 wherein said thickness sensor is located before, in a direction of object conveyance, of said conveying path.

12. The conveying unit in accordance with claim 10 wherein said thickness sensor is located before, in a direction of object conveyance, of said conveying path.

13. The conveying unit of claim 1 further including a roller drive mechanism, said first endless belt being coupled to said roller drive mechanism.

14. The conveying unit of claim 1 further including a roller drive mechanism, said first endless belt being driven by frictional contact with said roller.

15. The conveying unit of claim 2 wherein said drive arrangement is a frequency-regulated motor.

16. The conveying unit of claim 1 further including a folding apparatus of a cutting unit, said conveying unit being arranged in said folding apparatus.

17. The conveying unit of claim 1 wherein said roller is a cylinder of a folding apparatus.

18. The conveying unit of claim 17 wherein said cylinder is a collecting cylinder.

19. The conveying unit of claim 17 wherein said first endless belt loops around said cylinder over at least 90°.

* * * * *